US010386750B2

(12) United States Patent
Ushikubo

(10) Patent No.: US 10,386,750 B2
(45) Date of Patent: Aug. 20, 2019

(54) IMAGE FORMING UNIT AND DEVELOPER CONTAINER

(71) Applicant: Oki Data Corporation, Tokyo (JP)

(72) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/165,297

(22) Filed: Oct. 19, 2018

(65) Prior Publication Data

US 2019/0129331 A1 May 2, 2019

(30) Foreign Application Priority Data

Oct. 27, 2017 (JP) ..... 2017-208274

(51) Int. Cl.
*G03G 15/04* (2006.01)
*G03G 15/08* (2006.01)
*G03G 21/18* (2006.01)

(52) U.S. Cl.
CPC ..... *G03G 15/0875* (2013.01); *G03G 15/0896* (2013.01); *G03G 21/1842* (2013.01)

(58) Field of Classification Search
CPC ..... G03G 15/0875; G03G 15/0896; G03G 21/18; G03G 21/1803; G03G 21/1814; G03G 21/1842
See application file for complete search history.

(56) References Cited

U.S. PATENT DOCUMENTS

2008/0260422 A1* 10/2008 Sasae ..... G03G 15/0896 399/119
2013/0051810 A1* 2/2013 Nakamura ..... G03G 15/0126 399/12

FOREIGN PATENT DOCUMENTS

JP 2012-98501 A 5/2012

* cited by examiner

*Primary Examiner* — Hoang X Ngo
(74) *Attorney, Agent, or Firm* — Muncy, Geissler, Olds & Lowe, P.C.

(57) ABSTRACT

An image forming unit attachable and detachable with respect to an image forming apparatus includes a developer container in which a plurality of developer containing parts for containing respective developers are arranged on an arrangement line; and a detachable part that detachably supports the developer container wherein the developer container is mounted to the detachable part by sliding in mounting or detaching directions, wherein the detachable part has an engaging member that is rotatably supported, a downstream end part that is positioned at a downstream side of the developer container in the mounting direction. The downstream end part swings around the rotation shaft between a first position and a second position, the developer container has an engaged part that engages the downstream end part of the engaging member when the engaging member moves to the first position, and the downstream end part of the engaging member and the engaged part are engaged with each other and maintain a mounted state under which the developer container is mounted on the detachable part.

13 Claims, 7 Drawing Sheets

IMAGE FORMING UNIT AND DEVELOPER CONTAINER

TECHNICAL FIELD

The present invention relates to a developer container, an image forming unit, and an image forming apparatus, the developer container containing a developer.

BACKGROUND

A conventional developer container contains a developer to be supplied to an image forming unit of an image forming apparatus and is configured to be detachable with respect to the image forming unit (for example, see Patent Document 1).

RELATED ART

[Patent Doc.]

Japanese Laid Open Patent Application Publication 2012-98501

However, in the conventional technology, in a case of an image forming unit of a type for which a developer container is separated from the image forming unit, in order to improve operability, it is desirable that the developer container can be attached to or detached from the image forming unit with a simple operation, and, in order to prevent inadvertent removal of the developer container when the image forming unit is removed from the image forming apparatus, a lock is provided between the image forming unit and the developer container, and a locking operation is necessary after an operator attaches the developer container to the image forming unit, and thus, there is a problem that the operability deteriorates. The present invention is intended to solve such a problem and is intended to improve the operability when the developer container is attached to or detached from the image forming unit.

SUMMARY

An image forming unit attachable and detachable with respect to an image forming apparatus, disclosed in the application, includes a developer container in which a plurality of developer containing parts for containing respective developers are arranged wherein the developer containing parts are aligned on an arrangement line; and a detachable part that detachably supports the developer container wherein the developer container is mounted to the detachable part by sliding in a mounting direction that is along the arrangement line and detached from the detachable part by sliding in a detaching direction that is opposite to the mounting direction, wherein the detachable part has an engaging member that is rotatably supported by a rotation shaft extending in a direction orthogonal to the arrangement line, the engaging member has a downstream end part that is positioned at a downstream side of the developer container in the mounting direction, the downstream end part swinging around the rotation shaft such that the downstream end part is movable between a first position and a second position, the developer container has an engaged part that engages the downstream end part of the engaging member when the engaging member moves to the first position, and the downstream end part of the engaging member and the engaged part are engaged with each other and maintain a mounted state under which the developer container is mounted on the detachable part.

The present invention so accomplished achieves an effect that the operability can be improved when the developer container is attached to or detached from the image forming unit.

DETAILED DESCRIPTION OF PREFERRED EMBODIMENT(S)

In the following, an embodiment of a developer container, an image forming unit and an image forming apparatus of the present invention is described with reference to the drawings.

Embodiment

Figure 2:
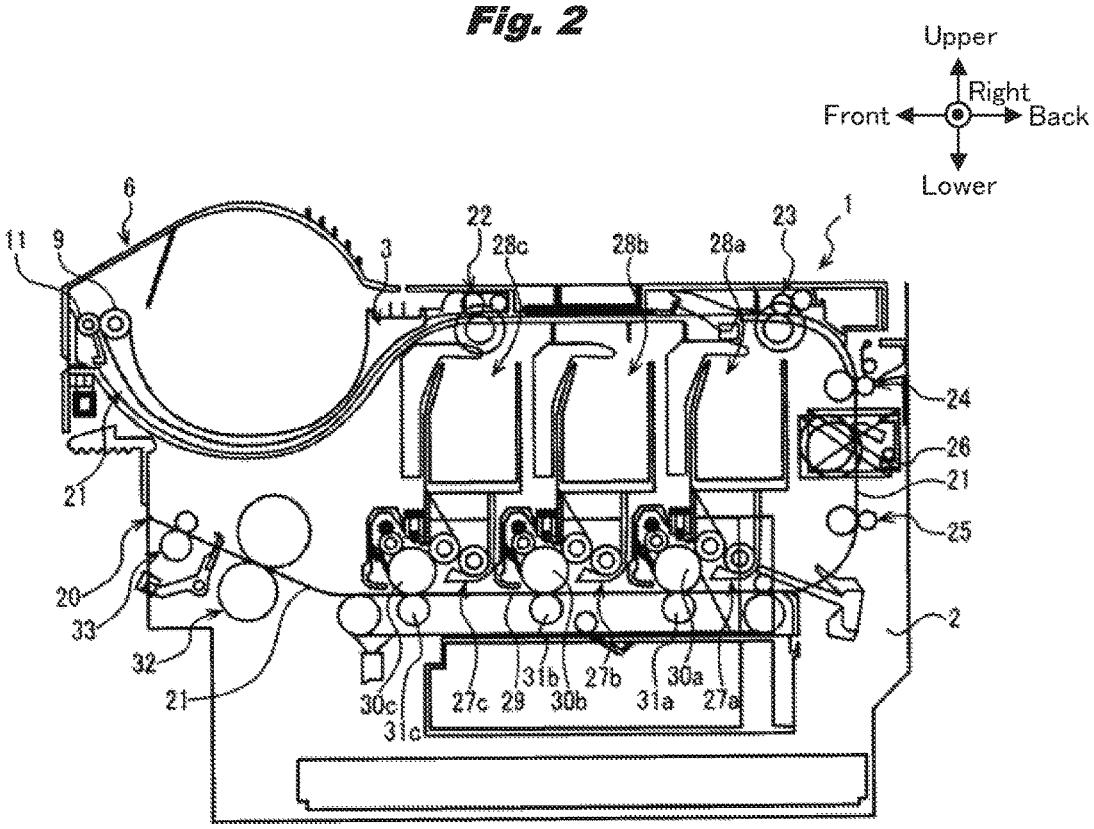
FIG. 2 is a schematic cross-sectional side view illustrating a configuration of an image forming apparatus of the embodiment.

FIG. 2 is a schematic cross-sectional side view illustrating a configuration of an image forming apparatus of the embodiment.

In FIG. 2, an image forming apparatus 1 is, for example, a roll sheet printer having an image forming unit using an electrophotographic method, and has a substantially box-shaped case 2. A surface on a left side of the case 2 in FIG. 2 is a front surface, and a face on a right side in FIG. 2 is a rear surface; a direction from the rear surface to the front surface of the case 2 is a frontward direction, and a direction from the front surface to the rear surface is a rearward direction; a direction from a lower side to an upper side of the case 2 is an upward direction, and a direction from the upper side to the lower side is a downward direction; and a direction from a front side to a back side of the case 2 in FIG. 2 is a leftward direction, and a direction from the back side to the front side of the case 2 in FIG. 2 is a rightward direction.

On an upper part of the case 2, on a front side thereof, a roll sheet container 3 containing a roll sheet wound in a cylindrical shape is provided. Further, on the upper part of the case 2, on the front side thereof, a cover 6 covering the roll sheet container 3 is attached.

The image forming apparatus 1 is configured to store the roll sheet wound in a cylindrical shape in a cylindrical space formed by a storage space of the roll sheet container 3 and a space on an inner side of the closed cover 6. In the roll sheet container 3, on a front end upper part of the storage space, a container-side carrying roller 9 and a cover-side carrying roller 11 are provided. When the cover 6 is closed, the cover-side carrying roller 11 is brought into contact with the container-side carrying roller 9, and the roll sheet can be sandwiched and carried.

Inside the case 2 of the image forming apparatus 1, a carrying path 21 is provided extending from a front end part of the roll sheet container 3 to a rear end part of the roll sheet container 3 along a lower side of the roll sheet container 3 and further connecting to a roll sheet ejection port 20 via carrying roller pairs 22, 23, 24, 25, 33.

The carrying path 21 is a path for carrying the roll sheet contained in the roll sheet container 3 to the roll sheet ejection port 20, and the roll sheet container 3 side is an upstream side and the roll sheet ejection port 20 side is a downstream side. The carrying roller pairs 22, 23, 24, 25, 33 are roller pairs that sandwich and carry the roll sheet. In order from the upstream side of the carrying path 21, the carrying roller pair 22, the carrying roller pair 23, the carrying roller pair 24, the carrying roller pair 25 and the carrying roller pair 33 are arranged.

A case-side cutter 26 for cutting the roll sheet is arranged between the carrying roller pair 24 and the carrying roller pair 25. Further, image forming parts 27*a*, 27*b*, 27*c* are arranged in the carrying path 21 between the carrying roller pair 25 and the carrying roller pair 33.

The image forming parts 27*a*, 27*b*, 27*c* form images of toners as developers of a plurality of colors (for example, 3 colors). In order from an upstream side of the carrying path 21, the image forming part 27*a*, the image forming part 27*b* and the image forming part 27*c* are arranged side by side. Toner containing parts 28*a*, 28*b*, 28*c* containing the respective toners are respectively attached to the image forming parts 27*a*, 27*b*, 27*c*. Further, an annular transfer belt 29 extending in a front-rear direction along the carrying path 21, and transfer rollers 31*a*, 31*b*, 31*c* are provided below the image forming parts 27*a*, 27*b*, 27*c*.

The transfer rollers 31*a*, 31*b*, 31*c* are respectively arranged at positions opposing photosensitive drums 30*a*, 30*b*, 30*c* of the image forming parts 27*a*, 27*b*, 27*c* across the transfer belt 29. A fuser 32 is provided on a downstream side of the transfer belt 29 in the carrying path 21. Further, a carrying roller pair 33 is provided near the roll sheet ejection port 20 on a downstream side of the fuser 32.

Figure 1:
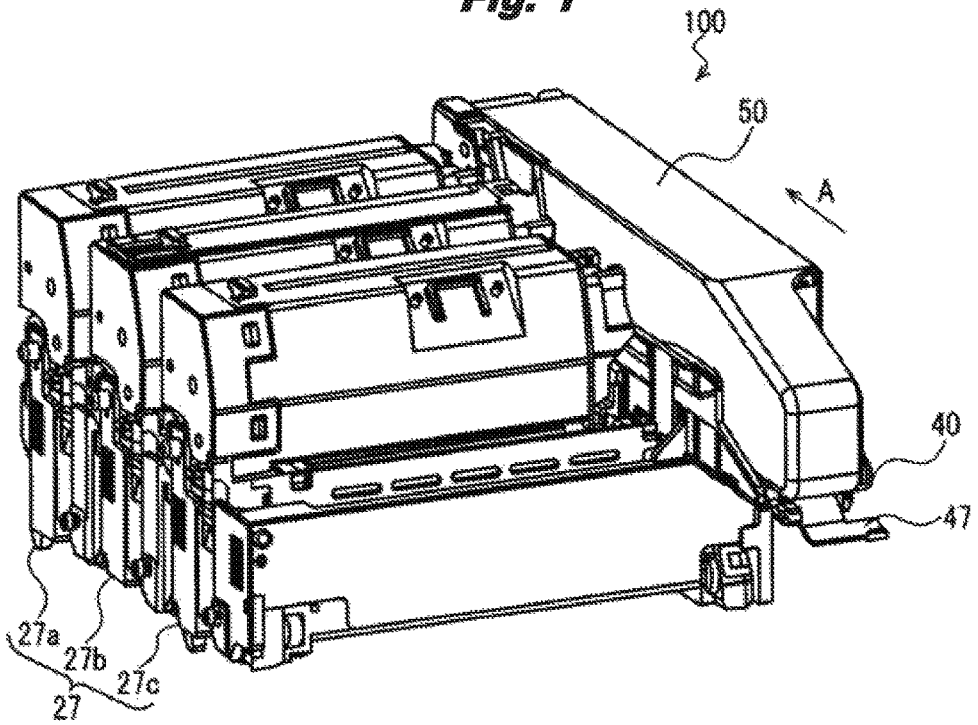
FIG. 1 is a perspective view illustrating a configuration of an image forming unit of an embodiment.

FIG. 1 is an external perspective view of the image forming unit of the embodiment. In FIG. 1, an image forming unit 100 has the image forming parts 27, a stage 40 and a toner cartridge 50. The image forming unit 100 is configured to be attachable to and detachable from the image forming apparatus 1 illustrated in FIG. 2.

The image forming parts 27 (27*a*, 27*b*, 27*c*) form toner images as developer images using an electrophotographic method. The image forming parts 27 include photosensitive drums (photosensitive drums 30*a*, 30*b*, 30*c* illustrated in FIG. 2) as rotatable image carriers, charging means for uniformly charging surfaces of the photosensitive drums, exposure means for selectively irradiating the surfaces of the charged photosensitive drums with light to form electrostatic latent images, and developing means for forming toner images by supplying toners as developers to the electrostatic latent images formed on the photosensitive drums.

The image forming parts 27 of the present embodiment include, for example, the image forming part 27*a* for forming a yellow toner image, the image forming part 27*b* for forming a magenta toner image, and image forming part 27*c* for forming a cyan toner image, which are arranged side by side in this order along a medium carrying direction. The stage 40 as a detachable part is provided on one end side of the image forming parts 27 (on the right side of the image forming apparatus 1 illustrated in FIG. 2) in a direction orthogonal to the medium carrying direction. The stage 40 detachably supports the toner cartridge 50.

The toner cartridge 50 as a developer container contains therein toners of the respective colors and is configured to be detachable with respect to the stage 40. When toners are insufficient in amount in the image forming parts 27*a*, 27*b*, 27*c*, by removing the toner cartridge 50 attached to the stage 40 and inserting and mounting a toner cartridge 50 containing toners of the respective colors to the stage 40 in a direction indicated by an arrow A in the drawings, toners of the respective colors can be respectively supplied to the image forming parts 27*a*, 27*b*, 27*c*.

Figure 3:
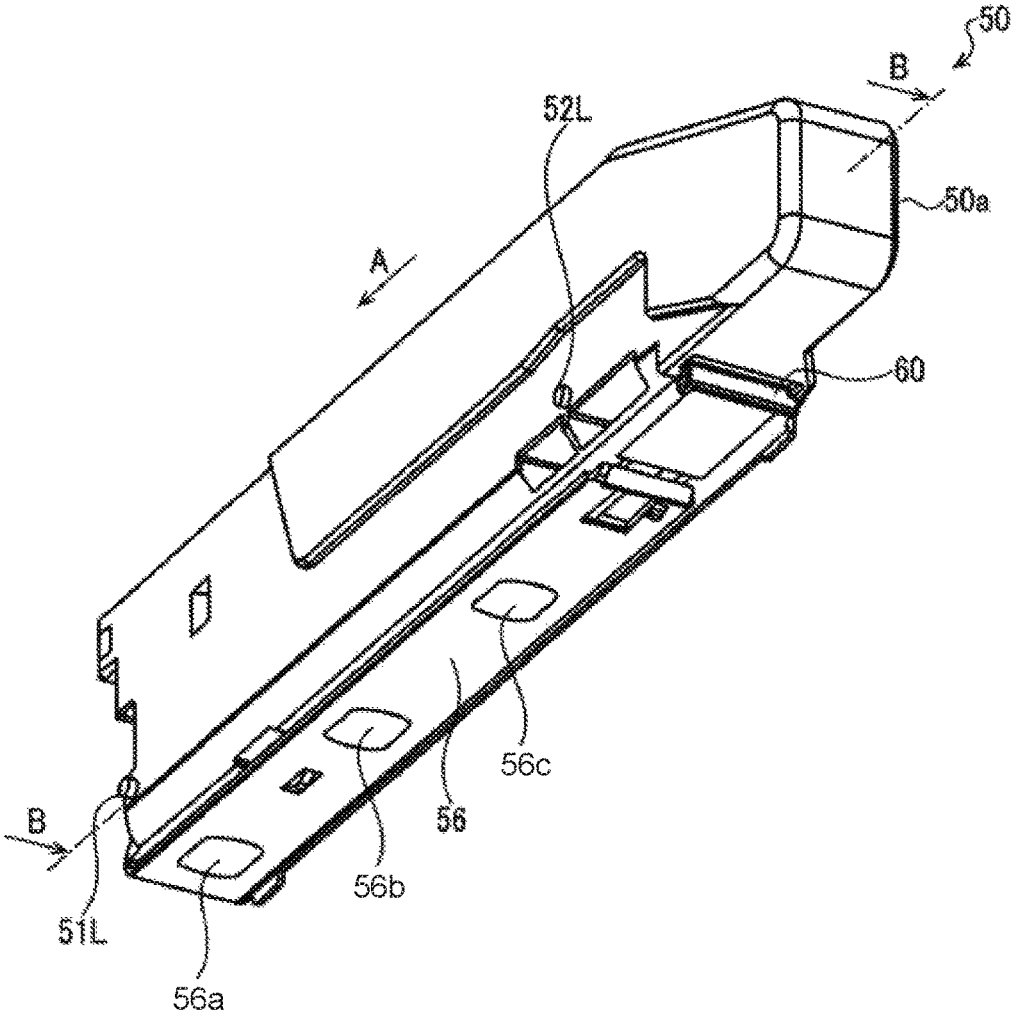
FIG. 3 is an external perspective view of a toner cartridge of the embodiment.

FIG. 3 is an external perspective view of the toner cartridge of the embodiment. In FIG. 3, in the toner cartridge 50, a post 51L and a post 52L as substantially cylindrical protruding parts are formed on a left side surface in a mounting direction indicated by an arrow A in the drawings with respect to the stage 40 illustrated in FIG. 1, and two posts as substantially cylindrical protruding parts are formed a right side surface. The post 51L is formed on a front side of the toner cartridge 50 in the mounting direction indicated by the arrow A in the drawings, and the post 52L is formed on a rear side of the toner cartridge 50 in the mounting direction indicated by the arrow A in the drawings.

Further, a gripping part 50*a* for allowing an operator to operate the toner cartridge 50 is formed at a rear end part of the toner cartridge 50 on an upstream side in the mounting direction with respect to the stage. An operator can mount the toner cartridge 50 to the stage 40 (see FIG. 1) by gripping the gripping part 50*a* to move the toner cartridge 50 in the mounting direction indicated by the arrow A in the drawings, and can remove the toner cartridge 50 from the stage 40 (see FIG. 1) by moving the toner cartridge 50 in a direction opposite to the mounting direction indicated by the arrow A in the drawings.

Figure 4:
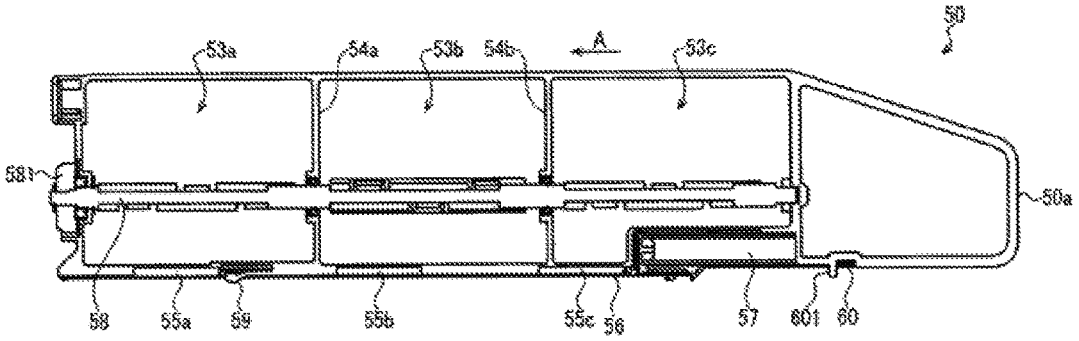
FIG. 4 is a cross-sectional view of the toner cartridge of the embodiment.
Figure 5:
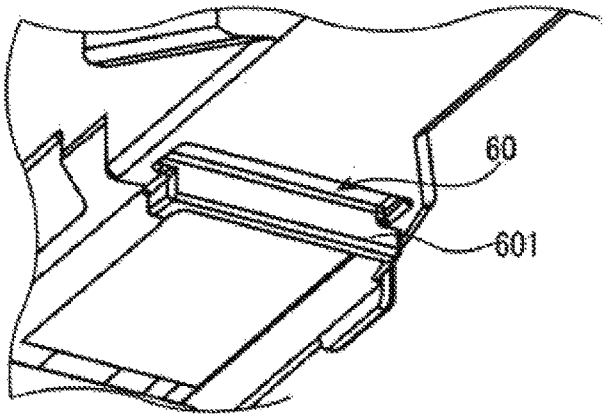
FIG. 5 is a perspective view of a recessed part of the embodiment.

FIG. 4 is a cross-sectional view of the toner cartridge of the embodiment (a cross-sectional view as viewed in a direction of arrows BB in FIG. 3). FIG. 5 is an enlarged perspective view of a recessed part in FIG. 3. In FIG. 4, the toner cartridge 50 has toner containing parts 53*a*, 53*b*, 53*c*, partition walls 54*a*, 54*b*, opening parts (or container opening parts) 55*a*, 55*b*, 55*c*, a shutter 56, a spring 57, an agitation member 58, a stopper 59, and a recessed part 60.

The toner containing parts 53*a*, 53*b*, 53*c* as developer containing parts are containing chambers for respectively containing toners of the respective colors, and are a plurality of developer containing parts arranged side by side in the mounting direction indicated by the arrow A in the drawings (the mounting direction of the toner cartridge 50 with respect to the stage). In the present embodiment, the toner containing parts 53*a*, 53*b*, 53*c* are arranged in the order of the toner containing part 53*a*, the toner containing part 53*b* and the toner containing part 53*c* from a front side (downstream side) in the mounting direction. A direction opposite to the mounting direction indicated by the arrow A in the drawings is a detachment direction (a detachment direction of the toner cartridge 50 with respect to the stage).

Therefore, an arrangement direction of the plurality of the developer containing parts is a detaching direction of the toner cartridge 50 with respect to the stage. The toner containing part 53*a* contains, for example, a yellow toner; the toner containing part 53*b* contains, for example, a magenta toner; the toner containing part 53*c* contains, for example, a cyan toner; and the toner containing parts 53*a*, 53*b*, 53*c* are respectively arranged so as to correspond to the image forming units 27*a*, 27*b*, 27*c* illustrated in FIG. 1.

In the present embodiment, a description is given in which 3 toner containing parts are provided. However, as long as the number of the toner containing parts corresponds to the number of the image forming units, the number of the toner containing parts may be 2 or 4 or more.

The partition walls 54*a*, 54*b* are walls for partitioning the toner containing parts. The partition wall 54*a* is arranged between the toner containing part 53*a* and the toner containing part 53*b*, and the partition wall 54*b* is arranged between the toner containing part 53*b* and the toner containing part 53*c*.

The opening parts 55*a*, 55*b*, 55*c* as first opening parts are holes that are respectively formed in lower portions of the toner containing parts 53*a*, 53*b*, 53*c*, and respectively allow the toners contained in the toner containing parts 53*a*, 53*b*, 53*c* to pass through. The opening parts 55*a*, 55*b*, 55*c* are formed to maintain predetermined lengths and predetermined intervals in the mounting direction indicated by the arrow A in the drawings. Therefore, the respective mounting direction lengths of the opening parts 55*a*, 55*b*, 55*c* are the same.

The shutter 56 as an opening and closing member is provided slidable in the mounting direction indicated by the arrow A in the drawings (and in the direction opposite to the mounting direction) at a lower portion of the toner cartridge 50, and is a plate-like member for closing or opening the opening parts 55*a*, 55*b*, 55*c*, and forms a bottom surface of the toner cartridge 50.

In the shutter 56, opening parts 56*a*, 56*b*, 56*c* are formed maintaining the same predetermined lengths and intervals as the opening parts 55*a*, 55*b*, 55*c* in the mounting direction indicated by the arrow A in the drawings. Therefore, when the opening parts 56*a*, 56*b*, 56*c* of the shutter 56 are positioned at positions that are respectively corresponding to the opening parts 55*a*, 55*b*, 55*c* of the toner containing parts, the opening parts 55*a*, 55*b*, 55*c* are opened, and, when the opening parts 56*a*, 56*b*, 56*c* of the shutter 56 are positioned at positions that are not respectively corresponding to the opening parts 55*a*, 55*b*, 55*c* of the toner containing parts, the opening parts 55*a*, 55*b*, 55*c* are closed.

Between the shutter 56 and the opening parts 56*a*, 56*b*, 56*c*, a sponge as a sealing material for preventing toner leakage is provided. The spring 57 as a biasing member is a biasing means for biasing the shutter 56 in the mounting direction indicated by the arrow A in the drawings. The shutter 56 biased by the spring 57 stops when being brought into contact with a contact part at a lower portion of the toner cartridge 50 and closes the opening parts 55*a*, 55*b*, 55*c* of the toner containing parts. FIG. 4 illustrates a state in which the shutter 56 is biased by the spring 57 of the toner cartridge 50 and closes the opening parts 55*a*, 55*b*, 55*c* of the toner containing parts.

The agitation member 58 is a rotatable member extending in the mounting direction indicated by the arrow A in the drawings, and is arranged so as to penetrate the toner containing parts 53*a*, 53*b*, 53*c*. A gear 581 is formed at a front end part of the agitation member 58 in the mounting direction. A rotational drive force from a drive source of the image forming apparatus 1 illustrated in FIG. 2 is transmitted to the gear 581 and the agitation member 58 rotates. Due to the rotation of the agitation member 58, the toners contained in the toner containing parts 53*a*, 53*b*, 53*c* are agitated, and coagulation or the like of the toners is suppressed. Seal members are respectively provided between the partition walls 54*a*, 54*b* and the agitation member 58 so that the toners contained in the toner containing parts 53*a*, 53*b*, 53*c* do not mix with each other.

The stopper 59 as an engaging member regulates the sliding of the shutter 56 by engaging a hole formed in the shutter 56 with a projecting part formed at a front end of the stopper 59. The projecting part at the front end is vertically movable and is supported, for example, in a cantilevered shape. In the present embodiment, the stopper 59 regulates the sliding of the shutter 56 such that a state is maintained in which the shutter 56 closes (or opens) the opening parts 55*a*, 55*b*, 55*c*. The toner cartridge 50 may have a configuration in which the stopper 59 is not included.

The recessed part 60 as an engaged part is formed at a lower portion of the gripping part 50*a* of the toner cartridge 50 and at substantially a lower portion of the gripping part 50*a* on an upstream side of the shutter 56 and the spring 57 in the mounting direction indicated by the arrow A in the drawings. On a downstream side of the recessed part 60 in the mounting direction, a wall part 601 of the recessed part 60 is formed so as to protrude from a lower portion of the gripping part 50*a* to a lower side which is the stage 40 side illustrated in FIG. 1. Further, the recessed part 60 is formed so as to extend in a direction orthogonal to the mounting direction indicated by the arrow A in the drawings (see FIG. 5).

The recessed part 60 maintains a mounted state of the toner cartridge 50 and the stage 40 by engaging a downstream end part (to be described later) of a lock plate 47 of the stage 40 illustrated in FIG. 1.

Figure 6:
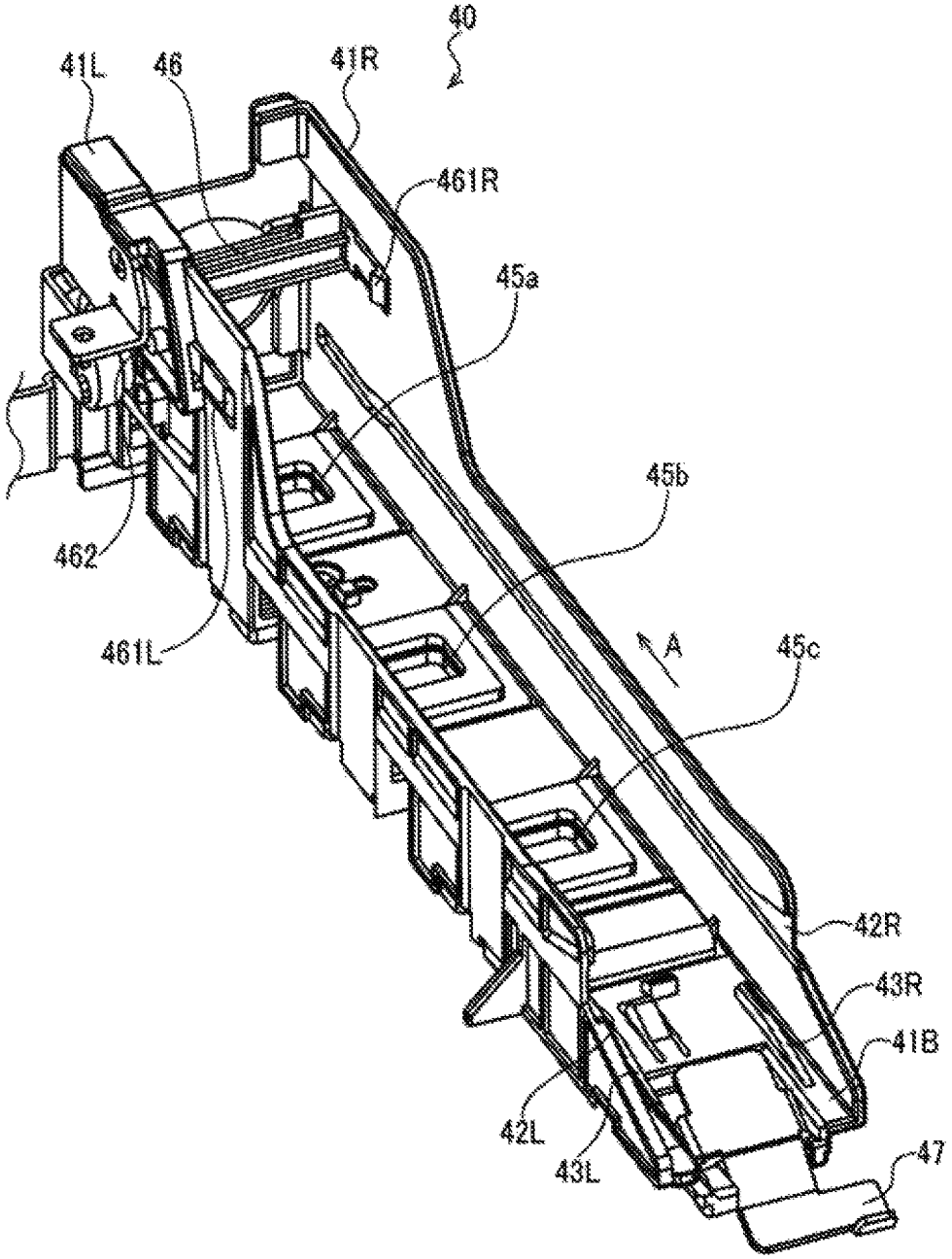
FIG. 6 is a perspective view of a stage of the embodiment.

FIG. 6 is a perspective view of the stage of the embodiment. In FIG. 6, the stage 40 has side walls 41L, 41R and a bottom plate 41B, rails 42L, 42R, limiters 43L, 43R, opening parts 45*a*, 45*b*, 45*c*, a holder 46, and a lock plate 47. The stage 40 is fixed to an upper portion of the image forming unit 100 illustrated in FIG. 1 with a screw or the like.

The side walls 41L, 41R are walls that are respectively formed on both left and right side portions of the stage 40 in the toner cartridge mounting direction indicated by the arrow A in the drawings. Further, the bottom plate 41B forms a bottom part of the stage 40, and is formed to have a first surface as an opposing surface that opposes/faces the mounted toner cartridge and a second surface that is on an opposite side with respect to the first surface.

The rails 42L, 42R as guiding parts are respectively formed on inner sides of the side walls 41L, 41R, and are guides (grooves) that are formed so as to extend along the toner cartridge mounting direction indicated by the arrow A in the drawings. The rails 42L, 42R slidably guide the toner cartridge 50 by engaging the posts as protruding parts formed on the both side portions of the toner cartridge 50 illustrated in FIG. 3.

The limiters 43L, 43R are respectively formed on inner sides of the side walls 41L, 41R on left and right side portions of the bottom plate 41B in a manner extending in the toner cartridge mounting direction indicated by the arrow A in the drawings and are convex members having a predetermined height. When the posts on the both side portions of toner cartridge 50 illustrated in FIG. 3 are engaged with the rails 42L, 42R, by being in contact with the both side portions of the toner cartridge 50, the limiters 43L, 43R cause the bottom surface of the toner cartridge 50 and the bottom plate 41B to separate from each other to prevent toner adhered to the bottom surface of the toner cartridge 50 from adhering to the bottom plate 41B and prevent toner adhered to the bottom plate 41B from adhering to the bottom surface of the toner cartridge 50.

The opening parts 45*a*, 45*b*, 45*c* as second opening parts are holes formed in the bottom plate 41B, and a plurality of opening parts 45*a*, 45*b*, 45*c* are formed corresponding to the opening parts 55*a*, 55*b*, 55*c* of the toner cartridge 50 illustrated in FIGS. 3 and 4. The opening parts 45*a*, 45*b*, 45*c* are formed maintaining the same lengths and the same intervals as the opening parts 55*a*, 55*b*, 55*c* of the toner cartridge 50 illustrated in FIGS. 3 and 4 in the mounting direction indicated by the arrow A in the drawings.

Further, the opening parts 45*a*, 45*b*, 45*c* respectively communicatively connect to the image forming parts 27*a*, 27*b*, 27*c* illustrated in FIG. 1, and allow toners that have passed through the opening parts 55*a*, 55*b*, 55*c* of the toner cartridge 50 to further pass through and be supplied to the image forming parts 27*a*, 27*b*, 27*c*.

Therefore, when the toner cartridge 50 illustrated in FIGS. 3 and 4 is mounted to the stage 40 arranged at the upper portion of the image forming unit 100 illustrated in FIG. 1, the opening parts 55*a*, 55*b*, 55*c* of the toner cartridge 50 respectively communicatively connect to the opening parts 45*a*, 45*b*, 45*c* and toners can be supplied to the image forming parts 27*a*, 27*b*, 27*c*.

The holder 46 as a holding member engages the toner cartridge 50 illustrated in FIG. 3 mounted to the stage 40 and holds the toner cartridge 50 at two predetermined positions. The holder 46 is supported by guide holes that are respectively provided in the side walls 41L, 41R so as to be slidable in the toner cartridge mounting direction and the opposite direction thereof.

Figure 8:
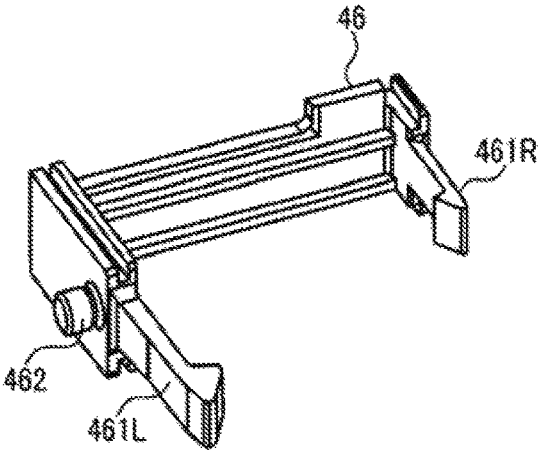
FIG. 8 is an external perspective view of a holder of the embodiment.

The holder 46 has a claw part 461L and a claw part 461R respectively projecting inward from the side wall 41L and the side wall 41R. The claw part 461L and the claw part 461R engage and hold the toner cartridge 50 by engaging holes of the toner cartridge 50 mounted to the stage 40. As illustrated in FIG. 8, the holder 46 has the claw part 461L and the claw part 461R, which engage the toner cartridge 50 illustrated in FIG. 3, and a protruding part 462.

The protruding part 462 is guided by a guide long hole formed in the side wall 41L and is slidable in the toner cartridge mounting direction and the opposite direction thereof. Therefore, the toner cartridge 50 held by the holder 46 is also slidable in the toner cartridge mounting direction and the opposite direction thereof in a slideable range of the protruding part 462 in the guide long hole. Further, the holder 46 is biased by a biasing member and a link mechanism or the like such as a torsion spring such that the protruding part 462 is in contact with an end part in the toner cartridge mounting direction, or an end part in the opposite direction thereof, of the guide long hole formed in the side wall 41L.

In the present embodiment, a position at which the protruding part 462 is in contact with an inner end part of the guide long hole in the toner cartridge mounting direction is a mounting completion position, and a position at which the protruding part 462 is in contact with an end part of the guide long hole in the opposite direction of the toner cartridge mounting direction is a holding start position. Therefore, the toner cartridge held by the holder 46 is also biased so as to be arranged at the mounting complete position or the holding start position.

The lock plate 47 as an engaging member is rotatably supported by a rotation shaft extending in a direction orthogonal to the detaching direction of the toner cartridge, and a downstream end part thereof on a downstream side in the mounting direction of the toner cartridge (the toner cartridge mounting direction indicated by the arrow A in the drawings) is configured to be movable between a first position and a second position (the first position and the second position will be described later). The lock plate 47 is supported to be rotatable about the rotation shaft of which two end parts in a direction orthogonal to the toner cartridge mounting direction indicated by the arrow A in the drawings are supported by the bottom plate 41B. Further, the lock plate 47 is arranged on an upstream side of the limiters 43L, 43R in the toner cartridge mounting direction close to the gripping part 50*a* of the toner cartridge 50 illustrated in FIG. 4, that is, arranged at an end part of the stage 40 on an upstream side in the toner cartridge mounting direction.

In the present embodiment, in order to improve operability, the lock plate 47 is arranged at a position close to the gripping part 50*a* of the toner cartridge 50 illustrated in FIG. 4. Further, by arranging the lock plate 47 at the end part of the stage 40 on the upstream side in the toner cartridge mounting direction, the configuration of the stage 40 of the downstream side can be simplified.

Figure 7:
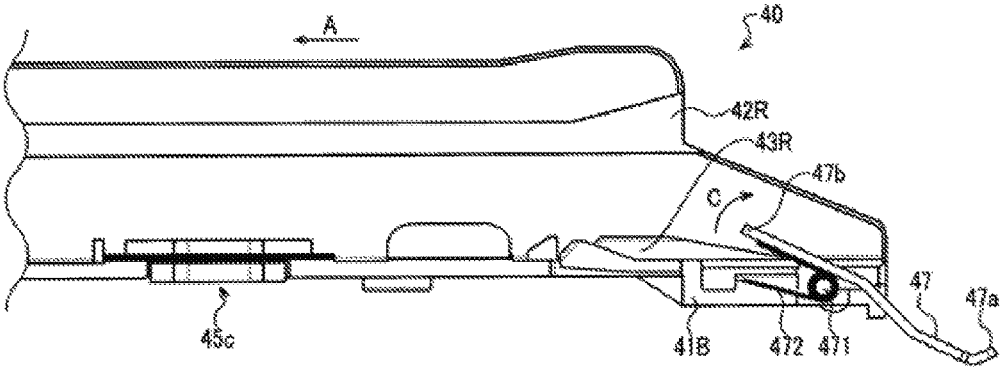
FIG. 7 is a cross-sectional side view of the stage and a lock plate of the embodiment.

FIG. 7 is a cross-sectional side view of the stage and the lock plate of the embodiment. In FIG. 7, the lock plate 47 of the stage 40 is arranged at an end part of the limiter 43R on an upstream side in the toner cartridge mounting direction indicated by the arrow A in the drawings, and has a rotation shaft 471 and a torsion spring 472.

The rotation shaft 471 is arranged on an upstream side of the limiter 43R in the toner cartridge mounting direction indicated by the arrow A in the drawings and rotatably supports the lock plate 47. The lock plate 47 is rotatably supported near a center portion thereof in the toner cartridge mounting direction by the rotation shaft 471 and can be rotated in a first direction indicated by an arrow C in the drawings and in a second direction which is an opposite direction of the first direction.

The lock plate 47 has an upstream end part 47*a* on an upstream side and a downstream end part 47*b* on a downstream side in the toner cartridge mounting direction, and is configured to be movable between a first position at which the downstream end part 47*b* protrudes upward from the opposing surface (the rotation shaft 471) as the first surface of the bottom plate 41B on the rail 42R side, and a second position at which the upstream end part 47*a* and the downstream end part 47*b* become substantially horizontal with respect to the rotation shaft 471, that is, the downstream end part 47*b* does not protrude from the bottom plate 41B.

The upstream end part 47*a* is arranged outside the stage 40 on an upstream side in the toner cartridge mounting direction, and the downstream end part 47*b* is arranged inside the stage 40. The torsion spring 472 as a biasing means is provided on the rotation shaft 471 and biases the downstream end part 47*b* of the lock plate 47 in the direction (first direction) indicated by the arrow C in the drawings which is a direction toward the first position ascended from the bottom plate 41B. The torsion spring 472 is arranged such that one end of the torsion spring 472 is in contact with the bottom plate 41B and the other end of the torsion spring 472 is in contact with the lock plate 47.

The lock plate 47 biased and rotated by the torsion spring 472 is brought into contact with the bottom surface of the toner cartridge mounted in the toner cartridge mounting direction indicated by the arrow A in the drawings and guides the toner cartridge.

The stage 40 configured as described above is arranged such that, when the image forming unit 100 illustrated in FIG. 1 is mounted to the image forming apparatus 1 illustrated in FIG. 2, the upstream end part 47*a* is in contact with a contact part formed in the image forming unit 100, the lock plate 47 rotates in the second direction (opposite direction of the first direction) against a biasing force of the torsion spring 472 so that the lock plate 47 becomes substantially parallel to the rail 42R, and the downstream end part 47*b* moves to the second position.

That is, when the image forming unit 100 illustrated in FIG. 1 is mounted to the image forming apparatus 1 illustrated in FIG. 2, the downstream end part 47*b* of the lock plate 47 is moved to the second position to allow the toner cartridge to be detachable from the stage 40; and, when the image forming unit 100 is removed from the image forming apparatus 1, the downstream end part 47*b* of the lock plate 47 is moved to the first position and the mounted state of the toner cartridge and the stage 40 is maintained. The lock plate 47 biased to the first position by the torsion spring 472 can be rotated to the second position by pressing a vicinity of the upstream end part 47*a* by an operation of an operator.

Figure 9:
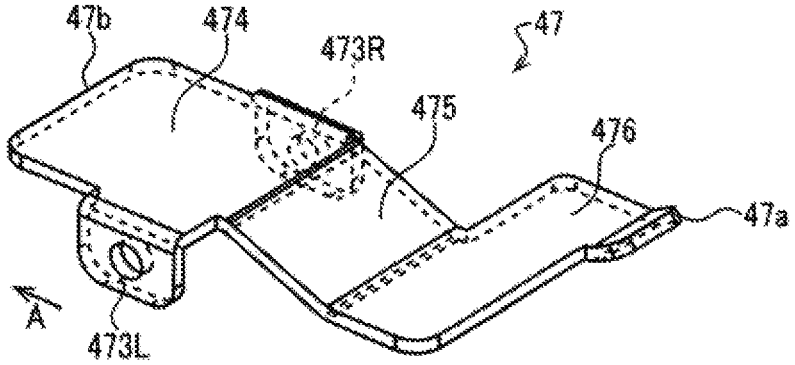
FIG. 9 is an external perspective view of the lock plate of the embodiment.

FIG. 9 is an external perspective view of the lock plate of the embodiment. In FIG. 9, the lock plate 47 has the upstream end part 47*a*, the downstream end part 47*b*, shaft holes 473L, 473R, a first flat surface part 474, an inclined surface part 475, and a second flat surface part 476.

The shaft holes 473L, 473R are through holes through which the rotation shaft 471 illustrated in FIG. 7 penetrates and serve as rotation fulcrums of the lock plate 47. The shaft hole 473L is provided on the left side of the lock plate 47 in the toner cartridge mounting direction indicated by the arrow A in the drawings, and the shaft hole 473R is provided on the right side of the lock plate 47 in the toner cartridge mounting direction indicated by the arrow A in the drawings. A distance between the shaft hole 473L and the shaft hole 473R is set to be substantially equal to a width of the toner cartridge 50 illustrated in FIG. 3 and a width of the stage 40 illustrated in FIG. 7 in a direction orthogonal to the toner cartridge mounting direction.

The first flat surface part 474 is a flat plate that forms a downstream portion of the lock plate 47 in the toner cartridge mounting direction. An end portion of the first flat surface part 474 on a downstream side in the toner cartridge mounting direction is the downstream end part 47*b*, and the shaft holes 473L, 473R are respectively formed in bent portions of the first flat surface part 474.

The inclined surface part 475 is a flat plate continuously formed from the first flat surface part 474 on an upstream side of the first flat surface part 474 in the toner cartridge mounting direction, and is formed so as to be inclined downward in the drawings from an end part of the first flat surface part 474 on the upstream side in the toner cartridge mounting direction.

That is, the inclined surface part 475 is formed so as to gradually approach the toner cartridge mounted to the stage 40 illustrated in FIG. 7 in the toner cartridge mounting direction. Therefore, the inclined surface part 475 is in contact with the toner cartridge inserted in the toner cartridge mounting direction and guides the toner cartridge to the first flat surface part 474.

The second flat surface part 476 is a flat plate formed on an upstream side of the inclined surface part 475 in the toner cartridge mounting direction so as to be continuous from the inclined surface part 475, and is formed so as to be parallel to the first flat surface part 474. The upstream end part 47*a* is formed at an end part of the second flat surface part 476 on an upstream side in the toner cartridge mounting direction.

Further, the second flat surface part 476 is formed to extend in a direction orthogonal to the toner cartridge mounting direction, and the upstream end part 47*a* is formed on an opposite side of the shaft hole 473L with respect to the shaft hole 473R. In this way, by forming the upstream end part 47*a* in the second flat surface part 476 which is away from a position between the shaft hole 473R and the shaft hole 473L, the upstream end part 47*a* can be prevented from coming into contact with the toner cartridge mounted to the stage.

Further, in the upstream end part 47*a*, a bent part is formed that is inclined (bent) in a direction opposite to the toner cartridge mounting direction with respect to the second flat surface part 476, that is, the bent part is formed that is bent toward the mounted toner cartridge side such that an inner angle formed by the bent part and the second flat surface part 476 is an obtuse angle.

In this way, by forming the bent part so that the upstream end part 47*a* is inclined (bent) in the direction opposite to the toner cartridge mounting direction with respect to the second flat surface part 476, a height of the upstream end part 47*a* relative to the second flat surface part 476 can be kept low, and the upstream end part 47*a* can be prevented from coming into contact with the toner cartridge mounted to the stage.

In the present embodiment, the upstream end part 47*a* is formed so as to be inclined in the direction opposite to the toner cartridge mounting direction with respect to the second flat surface part 476. However, a case where the upstream end part 47*a* is formed so as to be perpendicular to the second flat surface part 476 is not precluded.

An effect of the above-described configuration is described. First, an operation of the image forming apparatus is briefly described based on FIG. 2. A user sets a roll sheet in the roll sheet container 3 in a state in which a front edge portion of the roll sheet has been pulled out to the front of the roll sheet container 3. Thereafter, when the cover 6 is closed, the roll sheet is sandwiched between the container-side carrying roller 9 and the cover-side carrying roller 11.

In the image forming apparatus 1, in the state in which the roll sheet is sandwiched between the container-side carrying roller 9 and the cover-side carrying roller 11, the container-side carrying roller 9 is caused to rotate and carrying rollers of one side of the respective carrying roller pairs 22, 23, 24, 25, 33 are caused to rotate, and the roll sheet is carried along the carrying path 21 toward the transfer belt 29.

The roll sheet carried to the transfer belt 29 is carried by the transfer belt 29 and sequentially passes through between the photosensitive drums 30*a*, 30*b*, 30*c* and the transfer rollers 31*a*, 31*b*, 31*c* of the image forming parts 27*a*, 27*b*, 27*c*. In this case, toner images formed on the surfaces of the photosensitive drums 30*a*, 30*b*, 30*c* are transferred to a print side of the roll sheet.

The roll sheet to which the toner images have been transferred is carried to the fuser 32, and, after the toner images are fused by the fuser, is ejected from the roll sheet ejection port 20 by the carrying roller pair 33. The roll sheet is cut by a case-side cutter 26 at a predetermined length. Therefore, from the roll sheet ejection port 20, the printed roll sheet in a state of being cut to a predetermined length is ejected.

Figure 10:
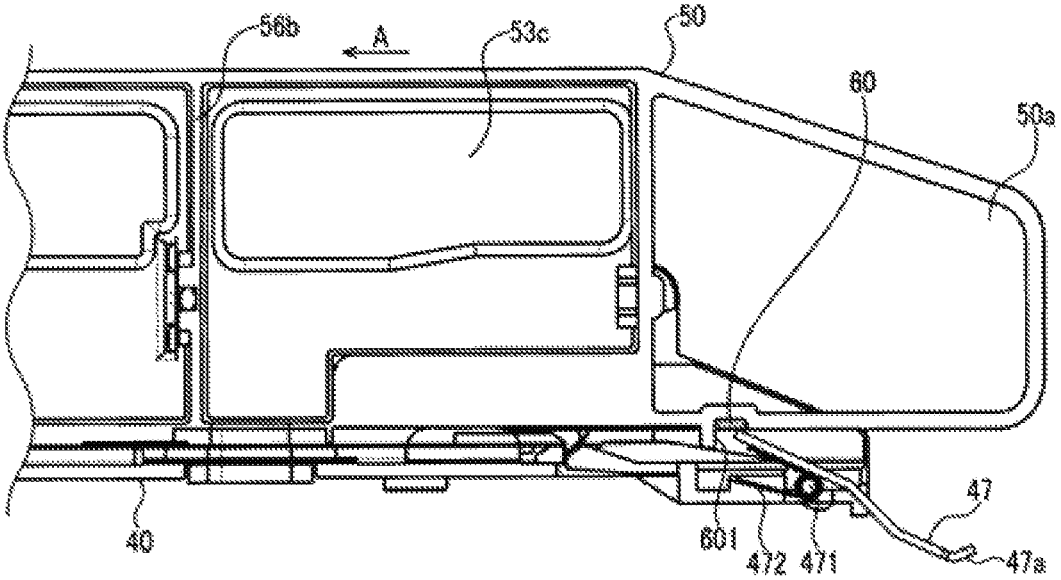
FIG. 10 is a side view of the stage and the toner cartridge of the embodiment.
Figure 11:
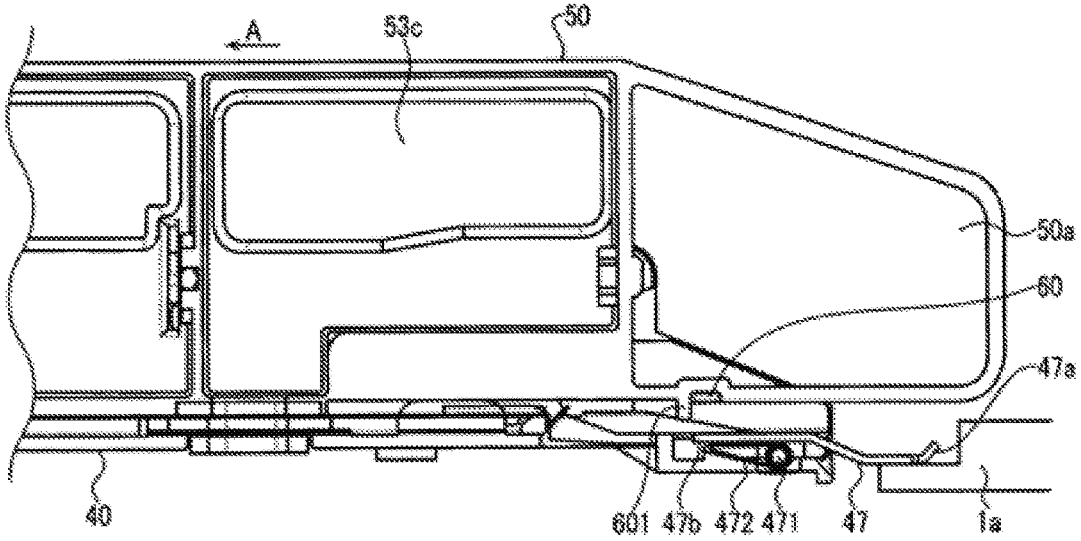
FIG. 11 is a side view of the stage and the toner cartridge of the embodiment.

Next, an effect when the toner cartridge is mounted to the stage is described with reference to FIGS. 7, 10 and 11. FIGS. 7, 10 and 11 are cross-sectional side views of the stage 40 and the toner cartridge 50. First, in the case where the image forming unit 100 illustrated in FIG. 1 is not mounted to the image forming apparatus 1 illustrated in FIG. 2, an effect when the toner cartridge 50 is mounted to the stage 40 is described.

FIG. 7 illustrates the stage 40 to which the toner cartridge 50 has not been mounted. In the state in which the toner cartridge 50 is not mounted to the stage 40, the lock plate 47 is biased in the direction indicated by the arrow C in the drawings by the torsion spring 472. Therefore, the downstream end part 47*b* of the lock plate 47 is arranged and held at the first position ascended from the bottom plate 41B on the rail 42R side.

Further, the upstream end part 47*a* of the lock plate 47 is arranged and held at a position descended from the bottom plate 41B of the stage 40.

In this state, when the toner cartridge 50 illustrated in FIG. 3 is mounted to the stage 40, the toner cartridge 50 is inserted into and mounted to the stage 40 in the toner cartridge mounting direction indicated by the arrow A in the drawings.

When the toner cartridge 50 passes over the lock plate 47, the lock plate 47 of which the upstream end part 47*b* is arranged at the first position is pressed by the bottom surface of the toner cartridge 50 and rotates in the direction opposite to the direction indicated by the arrow C in the drawings, and thus, does not interfere with the mounting of the toner cartridge 50 to the stage 40.

In this way, since the lock plate 47 is biased by the torsion spring 472 such that the downstream end part 47*b* of the lock plate 47 becomes higher than the upstream end part 47*a*, the toner cartridge 50 can be smoothly mounted to the stage 40. Further, the inclined surface part 475 of the lock plate 47 illustrated in FIG. 9 is in contact with the toner cartridge 50 inserted in the toner cartridge mounting direction and guides the toner cartridge 50 to the first flat surface part 474.

Further, since the upstream end part 47*a* of the lock plate 47 is formed in the second flat surface part 476 which is away from a position between the shaft hole 473R and the shaft hole 473L, the upstream end part 47*a* can be prevented from coming into contact with the toner cartridge 50 mounted to the stage 40.

Further, since the upstream end part 47*a* of the lock plate 47 illustrated in FIG. 9 is formed to be inclined in the direction opposite to the toner cartridge mounting direction with respect to the second flat surface part 476, the upstream end part 47*a* can be prevented from coming into contact with the toner cartridge 50 mounted to the stage 40.

FIG. 10 illustrates the stage 40 to which the toner cartridge 50 has been mounted. When the toner cartridge 50 is inserted into the stage 40 in the toner cartridge mounting direction indicated by the arrow A in the drawings, the downstream end part 47*b* of the lock plate 47 arranged at the position ascended from the bottom plate 41B is arranged inside the recessed part 60 of the toner cartridge 50. Further, the upstream end part 47*a* of the lock plate 47 is arranged at the position descended from the bottom plate 41B of the stage 40, that is, below the bottom plate 41B of the stage 40.

When the toner cartridge 50 is inserted into the stage 40, the toner cartridge 50 is held at the first position by the holder 46 illustrated in FIG. 6, and the downstream end part 47*b* of the lock plate 47 can be arranged inside the recessed part 60 of the toner cartridge 50.

In the state in which the downstream end part 47*b* of the lock plate 47 is arranged inside the recessed part 60 of the toner cartridge 50, the downstream end part 47*b* is in contact with and engages the wall part 601 inside the recessed part 60. Therefore, the toner cartridge 50 cannot be pulled out from the stage 40 in a removal direction (the direction opposite to the toner cartridge mounting direction indicated by the arrow A in the drawings).

Therefore, even when the gripping part 50*a* of the toner cartridge 50 is gripped and the image forming unit 100 illustrated in FIG. 1 is lifted, the image forming unit 100 does not fall off from the toner cartridge 50.

The downstream end part 47*b* of the lock plate 47 illustrated in FIG. 9 is in contact the wall part 601 of the recessed part 60 over a width direction of the toner cartridge 50 in the direction orthogonal to the toner cartridge mounting direction between the shaft hole 473R and the shaft hole 473L. Therefore, the engagement state between the stage 40 and the toner cartridge 50 can be maintained, and separation of the stage 40 and the toner cartridge 50 can be suppressed.

FIG. 11 illustrates the state of the toner cartridge 50 and the stage 40 when the image forming unit 1 illustrated in FIG. 1 is mounted to the image forming apparatus 1 illustrated in FIG. 2.

The stage 40 to which the toner cartridge 50 has been mounted (see FIG. 10) is fixed to the image forming unit 100 illustrated in FIG. 1. The image forming unit 100 to which the stage 40 has been fixed is mounted to the image forming apparatus 1 illustrated in FIG. 2 from above the image forming apparatus 1.

When the image forming unit 100 is mounted to the image forming apparatus 1, as illustrated in FIG. 11, the upstream end part 47*a* of the lock plate 47 of the stage 40 is in contact with a contact part 1*a* formed in the image forming apparatus 1 illustrated in FIG. 2. Further, the lock plate 47 of which the upstream end part 47*a* is in contact with the contact part 1*a* is rotated due to weight of the image forming unit 100, and the downstream end part 47*b* that was arranged inside the recessed part 60 (see FIG. 10) is arranged outside the recessed part 60. In this case, the lock plate 47 is arranged at the end part of the stage 40 on the opposite side of the toner cartridge mounting direction indicated by the arrow A in the drawings. Therefore, the upstream end part 47*a* of the lock plate 47 is in contact with the contact part 1*a* of the image forming apparatus 1, and thereby, the lock plate 47 can be rotated with a small force.

In this way, when the downstream end part 47*b* of the lock plate 47 is arranged outside the recessed part 60, the downstream end part 47*b* of the lock plate 47 does not enter the inside of the recessed part 60 and is not brought into contact the wall part 601 of the recessed part 60 of the toner cartridge 50. Therefore, the toner cartridge 50 can be pulled out in the opposite direction of the toner cartridge mounting direction indicated by the arrow A in the drawings. That is, by moving the downstream end part 47*b* of the lock plate 47 from the first position to the second position, the engagement between the downstream end part 47*b* and the recessed part 60 of the toner cartridge 50 is released, and detachment of the toner cartridge 50 from the stage 40 is enabled.

In this way, in the present embodiment, by providing the rotatable lock plate 47 in the stage 40, in the state in which the image forming unit is not mounted to the image forming apparatus, when the toner cartridge 50 is mounted to the stage 40, the downstream end part 47*b* of the lock plate 47 of the stage 40 engages with the recessed part 60 of the toner cartridge 50, and thereby, the toner cartridge 50 can be prevented from being detached from the image forming unit.

Further, in the state in which the image forming unit is mounted to the image forming apparatus, the engagement of the downstream end part 47*b* of the lock plate 47 of the stage 40 with the recessed part 60 of the toner cartridge 50 is released, and the toner cartridge 50 is detachable with respect to the stage 40.

Therefore, the operability in attaching or detaching the toner cartridge 50 to or from the stage 40 of the image forming unit can be improved.

Further, in the present embodiment, the rotatable lock plate 47 is provided in stage 40. Therefore, as compared to a case where a rod-like engaging member protruding upward from the stage 40 is engaged with the toner cartridge 50, the toner cartridge 50 can be smoothly mounted to the stage 40. This is because the bottom surface of the toner cartridge 50 to be mounted is guided by the first flat surface part 474, the inclined surface part 475 and the second flat surface part 476 of the lock plate 47 illustrated in FIG. 9 and the lock plate 47 is easily pressed down by the toner cartridge 50 to be mounted.

Further, in the present embodiment, by forming the recessed part 60 in the lower portion of the gripping part 50*a* of the toner cartridge 50 and providing the lock plate 47 of a stage 40 that engages the recessed part 60, that is, by arranging the gripping part 50*a*, the recessed part 60 and the lock plate 47 on the upstream side in the toner cartridge mounting direction, as illustrated in FIG. 10, when the toner cartridge 50 has been mounted to the stage 40, an operator can easily release the engagement between the lock plate 47 and the recessed part 60 by operating the gripping part 50*a* and the lock plate 47 simultaneously with one hand, and can detach the toner cartridge 50 from the stage.

As described above, in the present embodiment, by providing the rotatable lock plate in the stage, an effect is obtained that the operability in attaching or detaching the toner cartridge to or from the image forming unit can be improved.

Further, an effect is obtained that, even when the gripping part of the toner cartridge mounted to the image forming unit removed from the image forming apparatus is mistaken as the gripping part of the image forming unit, the image forming unit can be prevented from falling off from the toner cartridge.

Further, an effect is obtained that, when the toner cartridge is mounted to the stage of the image forming unit, a locking operation to prevent the toner cartridge from being detached from the image forming unit is not necessary, and the operability can be improved. In the present embodiment, the image forming apparatus is described as a roll sheet printer. However, the present invention is not limited to this. The image forming apparatus may also be a printer that prints precut sheets, or may be a facsimile machine, a multifunction peripheral (MFP), or the like as long as the image forming apparatus has a plurality of image forming units.

What is claimed is:

1. An image forming unit attachable and detachable with respect to an image forming apparatus, comprising:

a developer container in which a plurality of developer containing parts for containing respective developers are arranged wherein the developer containing parts are aligned on an arrangement line; and a detachable part that detachably supports the developer container wherein the developer container is mounted to the detachable part by sliding in a mounting direction that is along the arrangement line and detached from the detachable part by sliding in a detaching direction that is opposite to the mounting direction, wherein the detachable part has an engaging member that is rotatably supported by a rotation shaft extending in a direction orthogonal to the arrangement line, the engaging member has a downstream end part that is positioned at a downstream side of the developer container in the mounting direction, the downstream end part swinging around the rotation shaft such that the downstream end part is movable between a first position and a second position, the developer container has an engaged part that engages the downstream end part of the engaging member when the engaging member moves to the first position, and the downstream end part of the engaging member and the engaged part are engaged with each other and maintain a mounted state under which the developer container is mounted on the detachable part.

2. The image forming unit according to claim 1, wherein the detachable part has a bottom plate on which an opposing surface opposing the developer container is formed, the first position of the engaging member is a position at which the downstream end part protrudes from the opposing surface of the bottom plate of the detachable part, the detachable part has a biasing means that biases the engaging member such that the downstream end part is biased in a first direction, which is determined as a direction toward the first position from the second position, and the engaging member, which is being biased by the biasing means and has rotated in the first direction, becomes in contact with the developer container mounted by sliding in the mounting direction and is caused to rotate in a second direction that is an opposite direction of the first direction.

3. The image forming unit according to claim 2, wherein the rotation shaft of the engaging member is arranged parallel to the opposing surface of the bottom plate of the detachable part.

4. The image forming unit according to claim 3, wherein the image forming apparatus has a dock in which the image forming unit is inserted, the detachable part is independent from the developer container, functioning to attach to the dock such that the detachable part intervenes between the developer container and the dock when the image forming unit is inserted in the dock, each of the developer containing parts has a container opening part such that a contained developer exits from the container opening part, the bottom plate of the detachable part also has opening parts that are aligned with an interval along the arrangement line, these opening parts corresponding to the container opening parts such that, when the developer container is mounted on the detachable part, each of the opening parts of the detachable part meets with any one of the container opening parts making opening pairs of the container opening parts and the opening parts of the detachable parts, and the contained developers are supplied to the dock passing though the opening pairs.

5. The image forming unit according to claim 1, wherein the engaged part is a recessed part having a recessed shape formed in the developer container, and the downstream end part that has moved to the first position engages a wall part inside the recessed part.

6. The image forming unit according to claim 1, wherein the image forming unit has a contact part, the engagement member has an upstream end part that is positioned on an upstream side of the engagement member in the mounting direction, when the upstream end part is brought into contact with the contact part by the developer container moving in the detaching direction, the downstream end part moves from the first position to the second position.

7. The image forming unit according to claim 6, wherein when the downstream end part moves to the second position, the engagement of the engaging member with the engaged part is released, and the developer container is enable to be detached from the detachable part.

8. The image forming unit according to claim 6, wherein the engaging member further has a flat surface part that is in a plate shape and disposed between the upstream end part and downstream end part, and a bent part that is formed in the upstream end part by bending the flat surface part toward a side of the developer container to be mounted.

9. The image forming unit according to claim 1, wherein when the image forming unit is removed from the image forming apparatus, the downstream end part of the engaging member moves to the first position and the mounted state of the developer container and the detachable part is maintained, and, when the image forming unit is mounted to the image forming apparatus, the downstream end part of the engaging member moves to the second position such that the developer container is enable to be detached from the detachable part.

10. The image forming unit according to claim 1, wherein the engaging member is arranged at an end part of the detachable part on an upstream side in the mounting direction.

11. An image forming apparatus, comprising:

the image forming unit according to claim 1.

12. A developer container having a plurality of developer containing parts for containing respective developers, these developer containing parts being aligned on an arrangement line, being detachably supported by a detachable part, which is formed in an image forming unit attachable and detachable with respect to an image forming apparatus, in a detaching direction that is determined along the arrangement line, comprising:

a gripping part that is formed on an upstream side in a mounting direction, which is opposite to the detaching direction, with respect to the detachable part; and a recessed part that is in a recessed shape and engages an engaging member, the engaging member being formed in the vicinity of a lower portion of the gripping part and movably supported by the detachable part, wherein the recessed part has a wall part engaging an downstream end part of the engaging member and being formed inside the recessed part on a downstream side in the mounting direction.

13. An image forming apparatus, comprising the developer container according to claim 12.

* * * * *